United States Patent [19]

White

[11] Patent Number: 4,962,794

[45] Date of Patent: Oct. 16, 1990

[54] AIR JET LOOM WITH INTEGRAL STRETCH PIPE AND PICK SENSOR

[75] Inventor: James M. White, Toccoa, Ga.

[73] Assignee: Milliken Research Corporation, Spartanburg, S.C.

[21] Appl. No.: 395,980

[22] Filed: Aug. 21, 1989

Related U.S. Application Data

[63] Continuation-in-part of Ser. No. 263,807, Oct. 28, 1988, abandoned.

[51] Int. Cl.[5] ..... D03D 47/30; D03D 51/34

[52] U.S. Cl. ..... 139/370.2; 139/194

[58] Field of Search ..... 139/435.1, 429, 194, 139/370.2

[56] References Cited

U.S. PATENT DOCUMENTS

| | | | |
|---|---|---|---|
| 3,658,098 | 4/1972 | Mullekom . | |
| 3,880,198 | 4/1975 | Vermeuler . | |
| 4,465,110 | 8/1984 | Dekker . | |
| 4,473,096 | 9/1984 | Brouwer et al. . | |
| 4,498,504 | 2/1985 | Allen et al. . | |
| 4,570,683 | 2/1986 | Griffith | 139/194 |
| 4,729,411 | 3/1988 | Ellenberger et al. | 139/194 X |
| 4,838,321 | 6/1989 | Ishido et al. | 139/194 |

*Primary Examiner*—Andrew M. Falik

*Attorney, Agent, or Firm*—Earle R. Marden; H. William Petry

[57] ABSTRACT

An air jet weaving machine in which the pick sensor and the filling stretch pipe are combined to eliminate the space in the reed normally required to locate the pick sensor. The combination pick sensor and stretch pipe are located at the end of the reed remote from the filling air nozzle adjacent the filling yarn suction member.

2 Claims, 1 Drawing Sheet

AIR JET LOOM WITH INTEGRAL STRETCH PIPE AND PICK SENSOR

This application is a continuation-in-part of U.S. patent application Ser. No. 263,807 filed Oct. 28, 1988 for Air Jet Loom Control abn.

This invention relates to a method and apparatus to weave a yarn wherein the yarn is supplied into the shed of a loom by an air jet and is carried across the shed of the loom by a plurality of auxiliary jet nozzles supplied with air under pressure.

Normally in air jet looms a space is provided in the reed at the end of the shed away from the main filling nozzle to provide room to mount a pick sensor to detect the presence or absence of a fill yarn. Downstream from the pick sensor is mounted a stretch pipe to provide tension on the fill yarn during beat-up. The space required for the pick sensor is on the order of eight millimeters and when the loom is operating at a rate of 600 picks per minute this space requires considerable amount of fill yarn. In a weave room of about 500 looms this additional pick sensor space requires about $60,000–$80,000 of additional fill yarn per year.

It is therefore an object of the invention to provide an air jet loom using a reed which does not require an additional space for the pick sensor.

Other objects and advantages of the invention will become readily apparent as the specification proceeds to describe the invention with reference to the accompanying drawings, in which.

Figure 1:
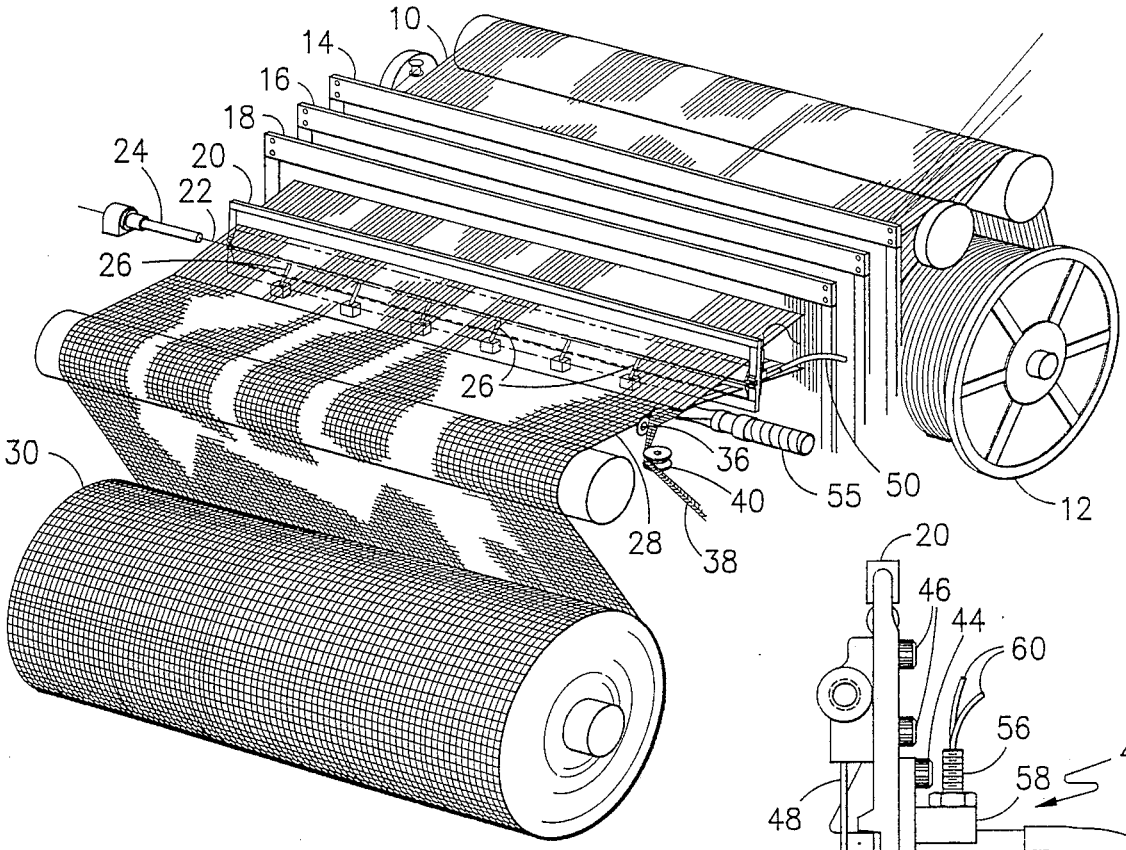
FIG. 1 is a schematic representation of the new and improved air jet loom.
Figure 3:
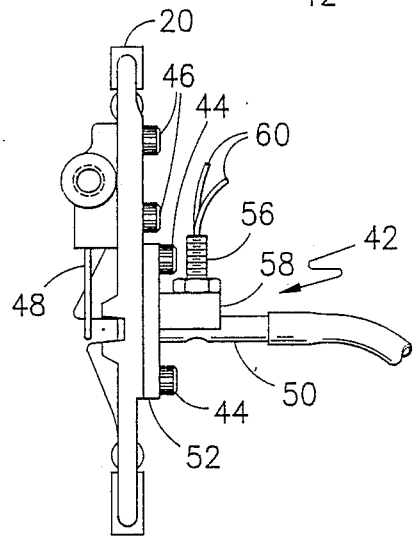
FIG. 3 is an end view of the reed shown in FIG. 2.
Figure 2:
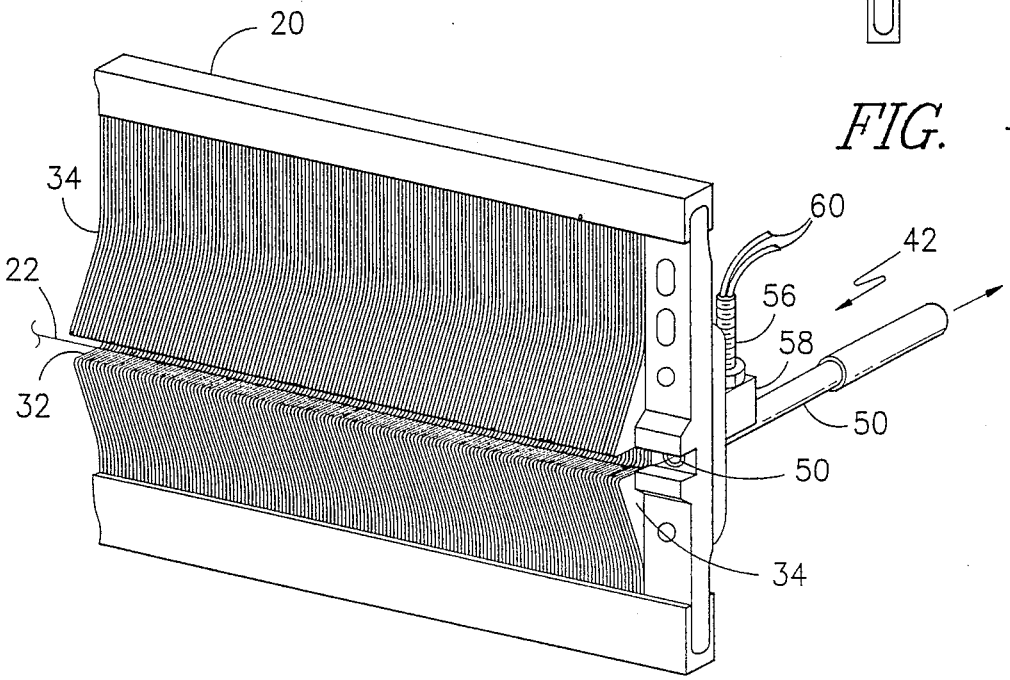
FIG. 2 is a perspective view of the reed used in the loom of FIG. 1.

Looking now to FIG. 1 a typical air jet weaving machine or loom is shown. In typical fashion, warp yarn 10 is supplied from a warp beam 12 through a plurality of harnesses 14, 16 and 18 to the reed 20 through which the fill yarn 22 is projected by the main air nozzle 24. The fill yarn 22 is assisted in its path of travel across the lay of the loom by a series of auxiliary air jets 26. On the beat-up motion, the reed 20 moves the fill yarn 22 into position in the previously formed fabric 28 being taken up on the take-up roll 30.

The reed 20, in typical manner, has a channel or tunnel 32 formed therein by the shape of the dents 34 for the passage of the fill yarn 22 across the loom. At the remote end of the lay across from the main nozzle 24 is a cutter 36 to trim the selvage of the fabric so that the catch cord 38 can be guided away from the loom by the roll 40. Mounted on the warp yarn side of the reed 20 is a combination pick sensor and stretch pipe assembly 42 by suitable screws 44. Mounted, by suitable screws 46, on the side of the reed 20 opposite to the assembly 42, is an air nozzle 48 to periodically blow air towards the stretch pipe 50 of the assembly 42.

The combination pick sensor and stretch pipe assembly 42 consists basically of a mounting plate 52 through which the stretch pipe 50 projects at one end and a fiber optic proximity sensor 56 threaded into the block 58 mounted on top of the stretch pipe. The sensor 56 is connected to the loom control circuit by suitable leads 60.

In operation when the fill yarn 22 passes the air jet 48 and the stretch pipe 50, the air jet 48 blows the fill yarn into the stretch pipe 54 to hold the filling yarn tight. At the same time the optic sensor senses the fill yarn in the stretch pipe and maintains the loom in operation. When the fill yarn has been beat-up the air source on the air jet 48 is cut off and the fill yarn just released from the stretch pipe is picked up and held taut in conventional manner by the suction pipe 55. Then the reed is moved back into its fill yarn receiving position and the air jet 48 is once again supplied air when the fill yarn has reached the appropriate position in the tunnel 32. Obviously, if no fill yarn is blown into the stretch pipe the optic sensor 56 will shut down the loom operation until the operator corrects the cause of the missing or broken fill yarn.

It can readily been seen that the combination sensor and stretch pipe eliminates the need to provide additional head space for a fill yarn sensor if the sensor was a separate entity. As discussed briefly before the elimination of this head space reduces the length of required fill yarn on each stroke thereby providing a substantial savings in raw material cost over a period of time.

Although the preferred embodiment of the invention has been described specifically, it is contemplated that changes may be made without departing from the scope or spirit of the invention and it is desired that the invention be limited only by the scope of the claims.

I claim:

1. An air jet weaving machine comprising: a warp beam rotably mounted in one end of said machine, a fabric take-up roll rotably mounted at the other end of said machine and a reed mounted between said warp beam and said take-up roll having a transverse tunnel therein for passage of fill yarn from one side of said machine to the other side thereof, a first air nozzle mounted on one side of said machine adjacent the tunnel in said reed to transmit yarn from one side of said machine through said tunnel to the other side of said machine and a combination stretch pipe and yarn sensor mounted on the warp beam side of said reed adjacent said tunnel at the end thereof to apply tension to the fill yarn in said tunnel and sense the absence of a fill yarn in said tunnel, said stretch pipe projecting through the end of said reed in communication with the takeup roll side of said reed, a second air nozzle mounted on the take up-roll side of the reed facing the reed and said combination stretch pipe and yarn sensor to blow fill yarn into said stretch pipe at a predetermined time and a suction means mounted adjacent the side of said reed opposite to said first air nozzle to apply tension to the projected fill yarn after it has been released from said stretch pipe and the reed has been moved to the beat-up position.

2. The machine of claim 1 wherein said yarn sensor is an optical proximity yarn sensor mounted on the stretch pipe.

* * * * *